US012540806B1

(12) United States Patent
Janeski

(10) Patent No.: US 12,540,806 B1
(45) Date of Patent: Feb. 3, 2026

(54) .45-70 SHOTSHELL AND METHOD FOR MAKING

(71) Applicant: Robert A. Janeski, Wellsboro, PA (US)

(72) Inventor: Robert A. Janeski, Wellsboro, PA (US)

( * ) Notice: Subject to any disclaimer, the term of this patent is extended or adjusted under 35 U.S.C. 154(b) by 38 days.

(21) Appl. No.: 18/385,164

(22) Filed: Oct. 30, 2023

(51) Int. Cl.
*F42B 33/00* (2006.01)
*F42B 7/04* (2006.01)
*F42B 7/10* (2006.01)

(52) U.S. Cl.
CPC ..... *F42B 33/001* (2013.01); *F42B 7/04* (2013.01); *F42B 7/10* (2013.01)

(58) Field of Classification Search
CPC ..... F42B 7/00; F42B 7/02; F42B 7/04; F42B 7/10; F42B 33/00; F42B 33/001; F42B 33/10; F42B 5/285; F42B 5/307; F42B 7/06
USPC ..... 86/10; 102/448–463, 467
See application file for complete search history.

(56) References Cited

U.S. PATENT DOCUMENTS

| | | | | |
|---|---|---|---|---|
| 3,565,008 | A * | 2/1971 | Gulley | F42B 5/307 102/467 |
| 4,007,686 | A * | 2/1977 | Hugonet | F42B 7/06 102/467 |
| 5,088,169 | A * | 2/1992 | Touzet | F42B 33/10 86/44 |
| 8,807,040 | B2 * | 8/2014 | Menefee, III | F42B 5/03 102/460 |
| 9,109,850 | B2 * | 8/2015 | DeJong | F42B 7/04 |
| 2011/0185936 | A1 * | 8/2011 | Richardson | F42B 12/36 102/438 |
| 2019/0293395 | A1 * | 9/2019 | Yonashiro | F42B 33/12 |

OTHER PUBLICATIONS 410 shotshells in 45/70???, Shooters Forum, retrieved from https://www.shootersforum.com/threads/410-shotshells-in-45-70.9490/ on Oct. 18, 2023, 9 pages.

* cited by examiner

*Primary Examiner* — James S Bergin
(74) *Attorney, Agent, or Firm* — Hooker & Habib, P.C.

(57) ABSTRACT

A .45-70 shotshell is made using a .45-70 shotshell base and a .410 shotshell hull. The hull is received and retained in the shotshell base. The shotshell base may be formed from a .45-70 rifle cartridge.

14 Claims, 2 Drawing Sheets

.45-70 SHOTSHELL AND METHOD FOR MAKING

FIELD OF THE DISCLOSURE

The disclosure relates generally to firearm ammunition, and in particular to a .45-70 compatible shotshell and a method for making the shotshell.

BACKGROUND OF THE DISCLOSURE

The .45-70 rifle cartridge was originally developed in 1873 by the US government at its Springfield Armory for use with the single-shot "Trapdoor" Springfield rifle. The cartridge is also known as the .45-70 Government cartridge or the .45-70 U.S. Government cartridge. The cartridge was originally designed to shoot a 405 grain bullet using 70 grains of black powder in a copper case. A modern .45-70 rifle and a modern .45-70 rifle cartridge using smokeless gunpowder can handle even large game such as moose, grizzly bear, and bison.

A .45-70 rifle cartridge is intended to be shot from a .45-70 rifle. A .45-70 rifle cartridge includes a metallic .45-70 base and a metallic, tubular .45-70 case extending from the base. A .45-70 base and a .45-70 case are each made to be compatible with a .45-70 rifle to be shot from a .45-70 rifle. The .45-70 case holds the projectile (bullet) and gunpowder.

A .45-70 rifle cartridge is one of the first center-fire rifle cartridges developed. The base of the .45-70 rifle cartridge retains a primer that holds an ignition compound. The ignition compound ignites the gunpowder that propels the rifle cartridge out of the shotgun. After the rifle cartridge has been shot, the primer can be replaced in the base and the case reloaded for re-use of the rifle cartridge.

Specifications and performance of the .45-70 rifle cartridge are standardized in American National Standard Voluntary Industry Performance Standards for Pressure and Velocity of Centerfire Rifle Ammunition for the Use of Commercial Manufacturers, SAAMI Z299.1-2018 maintained by the Sporting Arms and Ammunition Manufacturers' Institute, incorporated by reference as if fully set forth herein.

On the other hand, a .410 shotgun (also known as a 410 shotgun) is a shotgun that shoots a .410 shotshell, one of the smallest caliber shotgun shells that are widely available. A .410 shotgun is often used for small game hunting and for pest control.

A .410 shotshell (a shotshell is also referred to as a shotgun cartridge) is sold in different standard lengths. A 2½ inch .410 shotshell typically holds 3 or 4 pellets of No. 000 buckshot and 8 pellets of No. 4 buckshot. A 3 inch .410 shotshell typically holds 5 pellets of No. 000 buckshot and 9 pellets of No. 4 buckshot.

Alternatively, a .410 shotshell can be configured to hold a single slug instead of pellets.

A .410 shotshell is intended to be shot from a .410 shotgun. A .410 shotshell includes a metallic .410 base and a non-metallic. 410 hull received into the base. A .410 base is a base made to be compatible with a .410 shotgun and to be shot from a .410 shotgun. A .410 hull is a hull compatible with a .410 shotgun and a .410 base that holds the components of a loaded shotshell intended to be shot from a .410 shotgun.

A .410 hull is a tubular member having a first end disposed in a cap of the base, the base closing a first end of the hull. The hull extends out of the base to an opposite second end outside of the base. The hull holds the internal components of the loaded shotshell (for example, gunpowder, primer, wad, case, and pellets). The free end of the hull is crimped or rolled when the shotshell is loaded to retain the components inside the hull.

A .410 shotshell is a center-fire shotshell. The base of the .410 shotshell retains a primer that holds an ignition compound. The ignition compound ignites the gunpowder that propels the shotshell out of the shotgun. After the shotshell has been shot, the primer can be replaced in the base and the hull reloaded for re-use of the shotshell.

An unloaded shotshell or unloaded rifle cartridge casing for purposes of this disclosure is a shotshell or cartridge that includes a base and a hull or casing, and the base may or may not retain a primer. The hull or casing does not include the components normally held in the hull or casing before a shotshell or rifle cartridge is fired (gunpowder, projectile, etc.) and that is reloaded into the hull or casing when reloading the hull or casing.

Specifications and performance of the .410 shotshell are standardized in Voluntary Industry Performance Standards for Pressure and Velocity of Shotshell Ammunition for the Use of Commercial Manufacturers, SAAMI Z299.2-2019 maintained by the Sporting Arms and Ammunition Manufacturers' Institute, incorporated by reference as if fully set forth herein.

Although a .45-70 rifle is used for large game, some shooters have attempted to fire .410 shotshells from a .45-70 rifle. Because of the difference in size between a .45-70 rifle cartridge and a .410 shotshell, accuracy is detrimentally affected. And .410 shotshells in a .45-70 rifle magazine may not feed properly.

Some shooters have loaded an unloaded .45-70 rifle cartridge with shot, using a crimped over-shot wad or wax seal. But this is tedious and impractical for many shooters.

It remains desirable that a .45-70 rifle could also be used with a .45.70 shotshell for small game. This expands the use of a .45-70 rifle from large game using a .45-70 rifle cartridge to small game (rabbits, squirrels, birds, and the like) using a shotshell holding shot or a slug. A hunter carrying a .45-70 rifle could bring home both large game and small game using only one firearm.

SUMMARY OF THE DISCLOSURE

Disclosed is an unloaded .45-70 shotshell compatible with a .45-70 rifle.

The applicant/inventor was the first to realize that the hull of a .410 shotshell can be received into and retained by a base created from a .45-70 rifle cartridge casing, thereby forming an unloaded .45-70 shotshell. The unloaded .45-70 shotshell casing can be loaded with gunpowder and shot/slug for firing from a .45-70 rifle using conventional shotshell loading techniques.

An embodiment of a method for manufacturing an unloaded .45-70 shotshell in accordance with this disclosure includes the steps of:

- providing an unloaded .45-70 rifle cartridge;
- forming a .45-70 shotshell base from the cartridge casing of the unloaded .45-70 rifle cartridge;
- inserting a .410 hull into the .45-70 shotshell base; and
- retaining the inserted .410 hull in the .45-70 shotshell base.

An alternative method for manufacturing an unloaded .45-70 shotshell includes the steps of:

- providing a .45-70 shotshell base not manufactured from an existing unloaded .45-70 cartridge;

inserting a .410 hull into the .45-70 shotshell base; and retaining the inserted .410 hull in the .45-70 shotshell base.

A .45-70 shotshell in accordance with this disclosure has a number of advantages, in addition to enabling a .45-70 rifle to be used for both big game and small game. The shotshell is specifically sized to fit a .45-70 rifle so accuracy is improved. The shotshell can be made from readily available components such as .45-70 rifle cartridges and .410 hulls (assuming no supply-side disruptions presently affecting the supply of many common ammunition parts), and new .45-70 shotgun bases can easily be manufactured to supply a demand for .45-70 shotshells.

Other objects and features of the disclosure will become apparent as the description proceeds, especially when taken in conjunction with the accompanying drawing sheets illustrating one or more illustrative embodiments.

DETAILED DESCRIPTION

Figure 2:
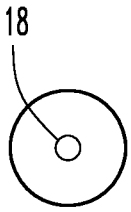
FIG. 2 PRIOR ART
FIG. 2 is an end view of the .45-70 rifle cartridge.
Figure 1:
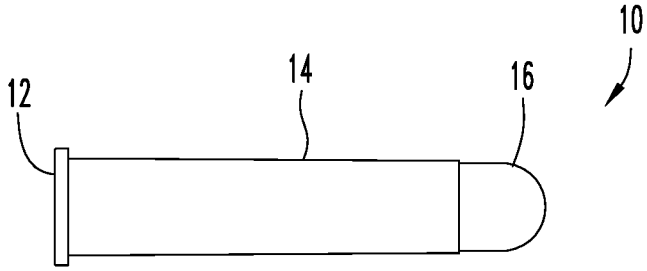
FIG. 1 PRIOR ART
FIG. 1 is a side view of a prior art .45-70 rifle cartridge.

FIGS. 1 and 2 illustrate a loaded .45-70 rifle cartridge 10. The dimensions of the illustrated cartridge 10 conform with the specifications of a .45-70 rifle cartridge as set forth in SAAMI Z299.1-2018.

The rifle cartridge 10 includes a base 12 and a case 14. The case 14 is a tubular member having a first end attached to and closed by the base. The case 14 extends away from the base 12 to a second end that holds a bullet 16. The case 14 of a loaded rifle cartridge 10 holds gunpowder (not shown).

The base 12 retains a primer 18. The primer 18 holds an ignition compound (not shown) that burns and ignites the gunpowder in the case 14. The primer is configured to be struck by the firing pin of a .45-70 rifle to ignite the ignition compound. After firing, the primer 18 can be replaced in the base 16 with a fresh primer 18.

Figure 4:
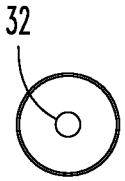
FIG. 4 PRIOR ART
FIG. 4 is an end view of the .410 shotshell.
Figure 3:
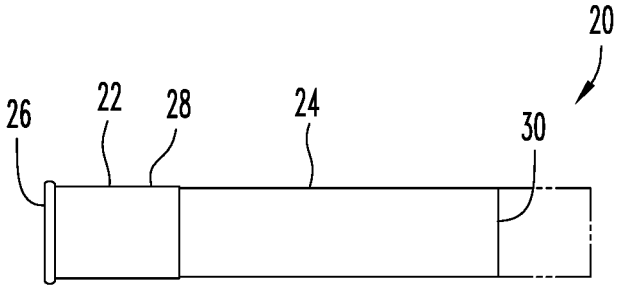
FIG. 3 PRIOR ART
FIG. 3 is a side view of a prior art .410 shotshell.

FIGS. 3 and 4 illustrate a loaded .410 shotshell 20. The dimensions of the illustrated shotshell 20 conform with the specifications of a .410 shotshell as set forth in SAAMI Z299.2-2019. The shotshell 20 shown in solid lines is a 2½ inch long shotshell, the phantom lines in FIG. 3 illustrate the extension of the shotshell 20 to a 3-inch long shotshell.

The shotshell 20 includes a base 22 and a hull 24. The base 22 includes a head 26 disposed at a first end the shotshell 20 and a tubular cap 28 extending from the head 26. The head 26 closes the adjacent end of the cap 28. The cap 28 extends away from the base 22 to an open second end of the cap. The SAAMI specification does not specify the overall axial length of the base 22; a typical base length is 0.7 inches but this can vary among manufacturers.

The hull 24 is a tubular member having a first end received in the open end of the cap 28. The hull 24 is seated against the head 26 and is press-fit in the cap 28 to retain the hull 24 in the cap 28 even after firing and to allow reloading of an emptied hull 24. The hull 24 extends away from the base 22 to a second end 30 that is rolled or crimped to retain the contents of a loaded hull 24 (gunpowder, projectile(s), etc.).

The base 22 of a .410 shotshell retains a primer 32 that holds an ignition compound (not shown).

A method for forming an unloaded .45-70 shotshell includes the steps of:

(a) providing an unloaded .45-70 rifle cartridge;

(b) forming a .45-70 shotshell base from the unloaded .45-70 rifle cartridge;

(c) inserting a .410 hull into the .45-70 shotshell base; and (d) retaining the inserted .410 hull in the .45-70 shotshell base.

Figure 5:
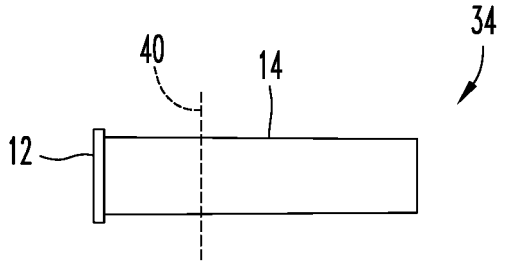
FIG. 5 PRIOR ART
FIG. 5 is a side view of an unloaded .45-70 rifle cartridge casing provided for the manufacture of a .45-70 shotshell in accordance with this disclosure.

FIG. 5 illustrates an unloaded .45-70 rifle cartridge casing 34 being provided in step (a) of the method. A new unloaded rifle cartridge casing 34 (known as a .45-70 brass, usually sold without a primer) are available from ammunition retailers, or may be made by using a fired .45-70 rifle cartridge. The rifle cartridge casing 34 includes a base 12 and a case 14 (see also FIG. 1). The base 12, for safety purposes, should not include a primer when starting the method.

Figure 6:
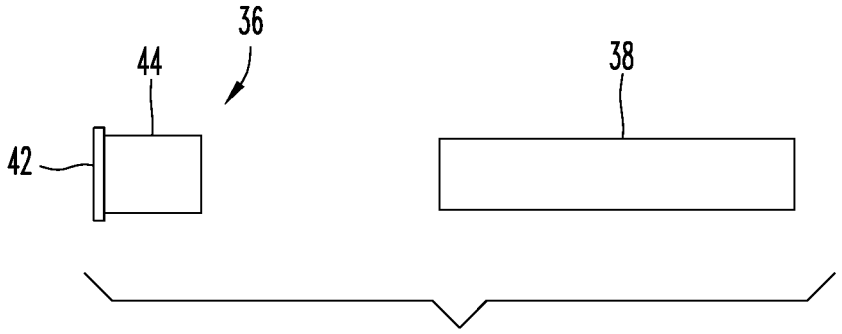
FIG. 6 is a side view of a .45-70 base formed from the .45-70 rifle cartridge casing shown in FIG. 5, the open end of the base being longitudinally aligned with an empty .410 hull, wherein forming the base is a step of the method.

FIG. 6 illustrates a .45-70 shotshell base 36 formed from the unloaded .45-70 rifle cartridge casing 34 in step (b) of the method, and also illustrates an accompanying .410 hull 38.

The shotshell base 36 in an embodiment of method step (b) is made by cutting the case 14 of the rifle cartridge casing 34 to a desired length through a vertical plane represented by the dashed line 40 in FIG. 36. The base 12 of the cartridge casing 34 forms the base or head 42 of the shotshell base 36. The portion of the cut case 14 attached to the base 12 forms the cap 44 of the shotshell base 36. The illustrated shotshell base 36 has an axial length of 0.7 inches, but the .45-70 rifle cartridge casing 34 can be cut to different lengths to obtain different length .45-70 shotshell bases.

The .410 hull 38 shown in FIG. 6 is empty and has not been rolled or crimped. The .410 hull 38 is shown prior to being inserted into the .45-70 shotshell base 36. The illustrated .410 hull 38 has a length that defines a 2½ inch .410 shotshell when inserted into a .410 shotshell base. .410 hulls of other lengths can be used with the method forming a portion of a .45-70 shotshell that meets desired projectile load and any maximum length requirements of a .45-70 rifle and its magazine, if any.

In method step (c), the .410 hull 38 is inserted into the .45-70 shotshell base 36. A first end of the .410 hull 38 is received into the open end of the shotshell base cap 44. In an embodiment of method step (c), the received end of the .410 hull is inserted sufficiently into the cap 44 to seat the hull 38 against the shotshell base head 42. The .410 hull 38 can be retained and fixedly secured in the .45-70 shotshell base 36 using adhesive (for example, an epoxy adhesive), crimping the .45-70 shotshell base 36 to form a non-translatable connection between the base and hull, by other means known in the art for securing a hull to a case, or by combinations thereof.

Figure 7:
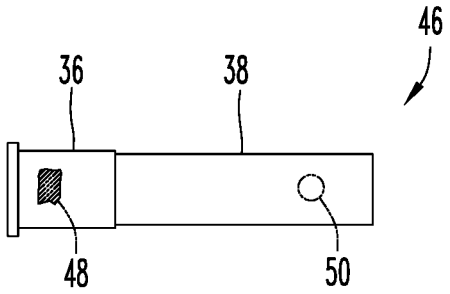
FIG. 7 is similar to FIG. 6 but illustrates the hull inserted into and retained by the base to form an unloaded .45-70 shotshell, wherein inserting the hull into the base and retaining the inserted hull in the base are steps of the method.

FIG. 7 illustrates the completed unloaded .45-70 shotshell 46 after performing method step (d), retaining the inserted .410 hull 38 in the .45-70 shotshell base 36. In an embodiment of method step (d), the .410 hull 38 is retained in the cap 44 by a press-fit.

The unloaded .45-70 shotshell 46 is ready for loading, receiving a .45-70 rifle cartridge primer in the base 12, gunpowder 48 (shown in phantom lines in FIG. 7) and at least one projectile 50 (shown in phantom lines in FIG. 7). The at least one projectile 50 may be a slug, or one or more shot, or some other projectile. The open second end of the hull 38 of a loaded .45.70 shotshell 45 is crimped/rolled before use of the shotshell as ammunition in a .45-70 rifle.

In a variant embodiment of the preceding method, a .45-70 shotshell base 36 can be provided as the starting point of the disclosed method, instead of providing a .45-70 rifle cartridge and forming the .45-70 shotshell base from the cartridge. That is, the .45-70 shotshell base can be manufactured directly from raw materials and does not necessarily have to be manufactured from an already existing .45-70 rifle cartridge.

A .45-70 shotshell in accordance with this disclosure could be reloaded after shooting using a reloader used for reloading .410 shotshells but modified to accept a .45-70 shotshell base.

While this disclosure includes one or more illustrative embodiments described in detail, it is understood that the one or more embodiments are each capable of modification and that the scope of this disclosure is not limited to the precise details set forth herein but include such modifications that would be obvious to a person of ordinary skill in the relevant art including (but not limited to) changes in material selection, length of cap, and length of hull, as well as such changes and alterations that fall within the purview of the following claims.

What is claimed is:

1. A method for manufacturing a .45-70 shotshell comprising the steps of:

(a) providing a .45-70 shotshell base;

(b) inserting a .410 hull into the .45-70 shotshell base; and (c) retaining the inserted .410 hull in the .45-70 shot shell base.

2. The method of claim 1 wherein step (a) comprises the steps of:

(d) providing a .45-70 rifle cartridge casing; and (e) forming a .45-70 shotshell base from the .45-70 rifle cartridge casing.

3. The method of claim 2 wherein the .45-70 rifle cartridge casing comprises a base and a case extending away from the base, and step (e) comprises the step of:

(f) cutting the case to form the .45-70 shotshell base wherein the .45-70 rifle cartridge base is the head of the .45-70 shotshell base.

4. The method of claim 3 wherein step (d) comprises the step of:

(f) providing an unloaded .45-70 rifle cartridge.

5. The method of claim 4 wherein the unloaded .45-70 rifle cartridge does not include a primer.

6. The method of claim 1 further comprising the step of:

(d) inserting a primer into the .45-70 shotshell base.

7. The method of claim 1 wherein step (a) comprises the step of:

(d) providing a .45-70 shotshell base not manufactured from an existing .45-70 rifle cartridge or .45-70 cartridge casing.

8. A .45-70 shotshell comprising:

a .45-70 shotshell base; and a .410 hull inserted into the shotshell base and retained in the shotshell base.

9. The .45-70 shotshell of claim 8 wherein the .45-70 shotshell base is a portion of a .45-70 rifle cartridge casing.

10. The .45-70 shotshell of claim 8 not comprising a primer.

11. The .45-70 shotshell of claim 8 comprising a primer, gunpowder, and at least one projectile.

12. The .45-70 shotshell of claim 11 wherein the at least one projectile comprises at least one shot.

13. The .45-70 shotshell of claim 12 wherein the at least one shot comprises a plurality of shot.

14. The .45-70 shotshell of claim 11 wherein the at least one projectile comprises a slug.

* * * * *